US010136730B2

(12) United States Patent
Kim

(10) Patent No.: US 10,136,730 B2
(45) Date of Patent: Nov. 27, 2018

(54) CHAIR, STOOL ASSEMBLY, AND SYSTEM

(71) Applicant: Purdue Research Foundation, West Lafayette, IN (US)

(72) Inventor: Tong Jin Kim, West Lafayette, IN (US)

(73) Assignee: Purdue Research Foundation, West Lafayette, IN (US)

( * ) Notice: Subject to any disclaimer, the term of this patent is extended or adjusted under 35 U.S.C. 154(b) by 15 days.

(21) Appl. No.: 15/434,169

(22) Filed: Feb. 16, 2017

(65) Prior Publication Data

US 2017/0238712 A1 Aug. 24, 2017

Related U.S. Application Data

(60) Provisional application No. 62/297,226, filed on Feb. 19, 2016.

(51) Int. Cl.

| | |
|---|---|
| ***A47C 5/00*** | (2006.01) |
| ***A47C 4/00*** | (2006.01) |
| ***A47C 4/04*** | (2006.01) |
| ***A47C 11/00*** | (2006.01) |
| ***A47C 3/04*** | (2006.01) |
| ***A47C 4/02*** | (2006.01) |
| ***A47C 9/00*** | (2006.01) |

(52) U.S. Cl.

CPC ..... *A47C 4/04* (2013.01); *A47C 3/04* (2013.01); *A47C 4/02* (2013.01); *A47C 5/005* (2013.01); *A47C 9/00* (2013.01); *A47C 11/00* (2013.01)

(58) Field of Classification Search

None

See application file for complete search history.

(56) References Cited

U.S. PATENT DOCUMENTS 1,831,428 A * 11/1931 Sherman ..... A47C 1/146 297/380
2,100,979 A * 11/1937 Rowe ..... A47C 5/005 297/440.12
2,244,605 A * 6/1941 Benoit ..... A47C 5/005 297/381
2,313,362 A * 3/1943 Rous ..... A47C 5/005 206/326

(Continued)

*Primary Examiner* — James M Ference
*Assistant Examiner* — Kyle J. Walraed-Sullivan
(74) *Attorney, Agent, or Firm* — Hartman Global IP Law; Gary M. Hartman; Domenica N. S. Hartman

(57) ABSTRACT

A chair including structural members having hinge joints at ends thereof pivotally coupling each of the members to one or more adjoining members. The chair is configured to be arranged in a collapsed configuration wherein all of the members are in the same plane and define a substantially planar shape, and configured to be arranged in an expanded configuration to define a seat, armrests, support legs, and leg braces of the chair. A stool assembly includes at least first and second stools configured to be stackable such that the seats of the stools abut face to face and in combination define a composite base. A system for constructing furniture includes multiple joints each having slots configured to receive and retain structural members and configured to be assembled with the structural members to form a piece of furniture with the multiple joints defining corners of the piece of furniture.

7 Claims, 12 Drawing Sheets

(56) References Cited

U.S. PATENT DOCUMENTS 2,616,773 A * 11/1952 Sanford ..... A47B 13/06 108/159
2,649,147 A * 8/1953 Sanford ..... A47C 3/12 297/411.41
2,670,787 A * 3/1954 Vandas ..... A47C 3/12 297/411.41
2,806,514 A * 9/1957 Smith ..... A47C 5/005 297/440.12
2,940,513 A * 6/1960 Holden ..... A47C 5/005 297/440.12
3,019,051 A * 1/1962 Nugent ..... A47C 7/20 297/218.1
3,121,588 A * 2/1964 Beckman ..... A47C 5/005 297/1
3,126,140 A * 3/1964 Lizan ..... A47C 5/005 108/115
3,149,880 A * 9/1964 Steuer ..... A47C 5/005 297/440.12
3,178,227 A * 4/1965 Snyder ..... A47C 5/005 229/113
3,331,634 A * 7/1967 Harrison, Jr. ..... A47C 4/03 297/440.12
3,359,036 A * 12/1967 Druth ..... A47C 1/146 108/46
3,604,751 A * 9/1971 Caigan ..... A47C 5/005 229/800
3,606,459 A * 9/1971 Krone ..... A47C 5/005 297/440.12
3,608,916 A * 9/1971 Halko ..... A47B 85/00 297/440.12
3,627,086 A * 12/1971 Caigan ..... A47C 1/146 190/8
3,664,705 A * 5/1972 Brody et al. ..... A47C 5/005 297/451.4
3,717,377 A * 2/1973 Johnson ..... A47C 5/005 297/440.12
4,025,106 A * 5/1977 Kyte ..... A47C 4/08 297/16.1
4,202,581 A * 5/1980 Fleishman ..... A47C 4/021 108/159
D256,857 S * 9/1980 Tallon ..... D6/374
4,385,782 A * 5/1983 Clark, Jr. ..... A47C 5/005 297/350
4,390,204 A * 6/1983 Fleishman ..... A47B 3/06 248/165
4,533,174 A * 8/1985 Fleishman ..... A47B 3/06 297/16.1
4,723,664 A * 2/1988 Smith ..... A47C 5/005 211/132.1
4,869,553 A * 9/1989 Powell ..... A47C 1/146 297/377
4,875,737 A * 10/1989 Cardenas ..... A47C 5/005 297/440.12
4,926,512 A * 5/1990 Coyle ..... A47C 1/143 297/377
5,020,854 A * 6/1991 Powell ..... A47C 1/146 297/377
5,259,578 A * 11/1993 Jones ..... A47C 5/005 211/24
5,263,766 A * 11/1993 McCullough ..... A47C 4/021 297/440.13
5,445,435 A * 8/1995 Sheckles ..... A47C 5/005 297/440.12
5,580,131 A * 12/1996 Ribot ..... A47C 5/005 297/440.12
D390,022 S * 2/1998 Jus ..... D6/368
5,795,027 A * 8/1998 Howard ..... A47C 5/005 297/440.1
5,860,704 A * 1/1999 Smith ..... A47C 5/005 297/440.1
6,048,032 A * 4/2000 Stewart ..... A47C 5/005 248/174
6,206,473 B1 * 3/2001 Kondratiev ..... A47B 13/003 297/440.1
7,472,960 B1 * 1/2009 Kuehn ..... A47C 3/16 248/174
7,654,611 B1 * 2/2010 Kesrouani ..... A47C 4/04 297/45
8,602,500 B1 * 12/2013 Warren ..... A47C 5/005 297/440.12
2003/0011232 A1 * 1/2003 Zeiler ..... A47C 5/00 297/440.11
2005/0071919 A1 * 4/2005 Kenan ..... A47C 4/021 5/93.1
2006/0186711 A1 * 8/2006 Phipps ..... A47C 4/14 297/46
2007/0012348 A1 * 1/2007 Hoberman ..... A47B 3/087 135/145
2009/0230734 A1 * 9/2009 Stell ..... A47B 85/00 297/16.1
2010/0045080 A1 * 2/2010 Haugan ..... A47C 1/146 297/183.5
2010/0201162 A1 * 8/2010 Leywood ..... A47C 5/005 297/16.1
2012/0098321 A1 * 4/2012 Wang ..... A47C 5/00 297/452.1
2012/0267920 A1 * 10/2012 Voris ..... A47C 4/045 297/16.1
2013/0080286 A1 * 3/2013 Rotholz ..... A47C 5/005 705/26.5
2014/0135193 A1 * 5/2014 Albarran-Torres .... A47B 47/06 493/390
2015/0289657 A1 * 10/2015 Gendell ..... A47C 4/08 297/16.1
2016/0081479 A1 * 3/2016 Lin ..... A47C 4/04 297/16.1
2016/0309903 A1 * 10/2016 Huang ..... A47C 12/00
2017/0099950 A1 * 4/2017 Lin ..... A47C 4/04

* cited by examiner

CHAIR, STOOL ASSEMBLY, AND SYSTEM

CROSS REFERENCE TO RELATED APPLICATIONS

This application claims the benefit of U.S. Provisional Application No. 62/297,226, filed Feb. 19, 2016, the contents of which are incorporated herein by reference. In addition, this application is related to U.S. patent application Ser. Nos. 29/559,485 and 62/297,226, each filed Mar. 29, 2016, the contents of which are incorporated herein by reference.

BACKGROUND OF THE INVENTION

The present invention generally relates to furniture. The invention particularly relates to pieces of furniture having reduced storage footprints and systems for building custom pieces of furniture.

A current trend in furniture and interior decoration focuses on minimalist designs which use fewer building materials, result in limited environmental impact, have a reduced physical footprint suitable for smaller living spaces, and incorporate relatively simple designs. In addition, as many designers incorporate fewer pieces into their living spaces, their focus appears to be more directed toward unique and/or custom pieces.

Accordingly, there is an ongoing desire for pieces of furniture that embodies one or more of the above trends.

BRIEF DESCRIPTION OF THE INVENTION

The present invention provides chairs, stool assemblies, and systems for constructing furniture.

According to one aspect of the invention, a chair includes multiple rigid structural members having hinge joints at ends thereof pivotally coupling each of the structural members to one or more adjoining structural members. The hinge joints define parallel axes so that the structural members pivot relative to each other about the parallel axes. The chair is configured to be arranged in a collapsed configuration wherein all of the structural members are in the same plane and define a substantially planar shape. The chair is also configured to be arranged in an expanded configuration wherein a first group of the structural members define a seat, a front set of support legs, and armrests of the chair, and a second group of the structural members define a rear set of support legs and leg braces connecting the front and rear set of support legs of the chair. The first group of structural members expand in a first outward direction relative to the plane of the structural members in the first configuration, and the second group of structural members expand in a second direction that is generally opposite the first outward direction. The structural members pivot about the parallel axes relative to the one or more adjoining structural members to transition between the first and second configurations.

According to another aspect of the invention, a stool assembly includes at least first and second stools each having a seat and legs configured to support a load applied to the seat. The second stool is shorter than the first stool and is configured to be stackably located under the first stool such that the seats of the first and second stools abut face to face and are parallel to each other. The first and second stools stack and in combination define a composite base that is configured to support a load applied to the seat of the first stool with the legs of both the first and second stools.

According to another aspect of the invention, a system for constructing furniture includes multiple joints each having slots configured to receive and retain structural members. The multiple joints are configured to be assembled with the structural members to form a piece of furniture, with the multiple joints defining corners of the piece of furniture.

Technical effects of the chair described above preferably include its ability to be deployed or expanded for use as a chair when desired, and to be collapsed for storage or shipping. Technical effects of the stool assembly described above preferably include the ability to disassemble the stools when more than one stool is desired, whereas when assembled together the stools effectively constitute a single stool that does not occupy more space than the largest of the stools. Technical effects of the system for constructing furniture as described above preferably include the ability to create custom furniture without extensive woodworking expertise, skills, or equipment.

Other aspects and advantages of the invention will be further appreciated from the following detailed description.

DETAILED DESCRIPTION OF THE INVENTION

Figure 1:
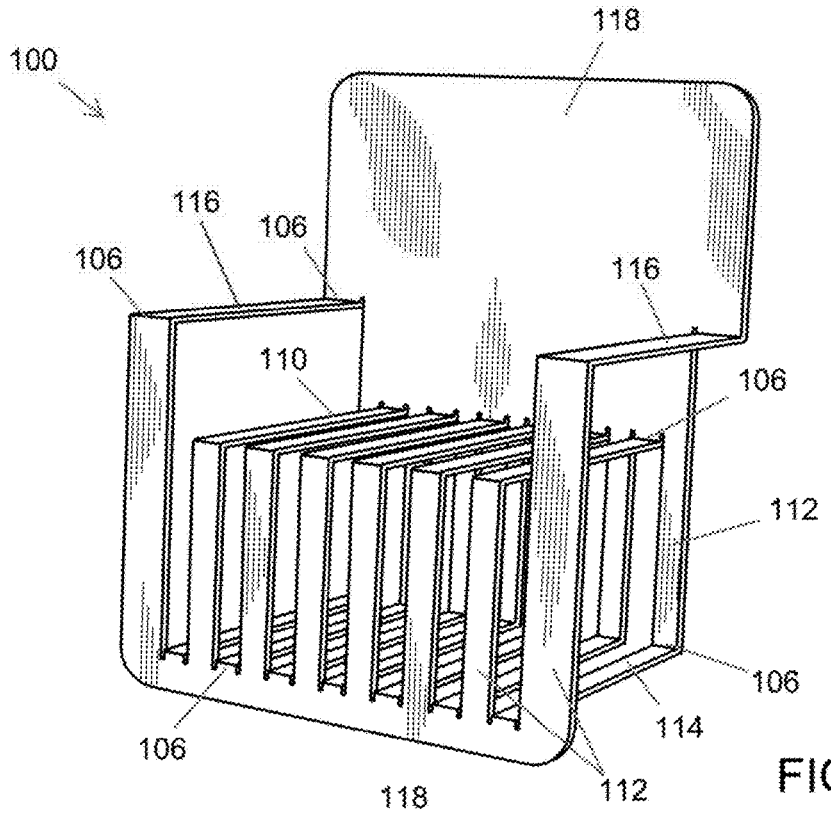
FIG. 1 is a front perspective view schematically representing a nonlimiting embodiment of a collapsible chair in an expanded configuration in accordance with one aspect of the invention
Figure 2:
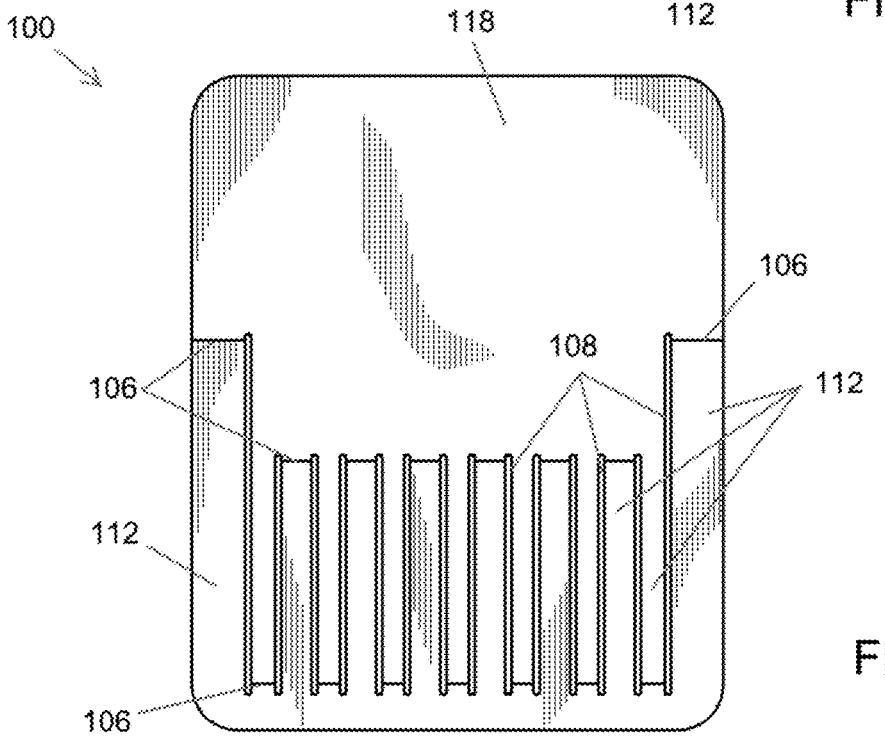
FIG. 2 is a front elevational view of the chair of FIG. 1.
Figure 3:
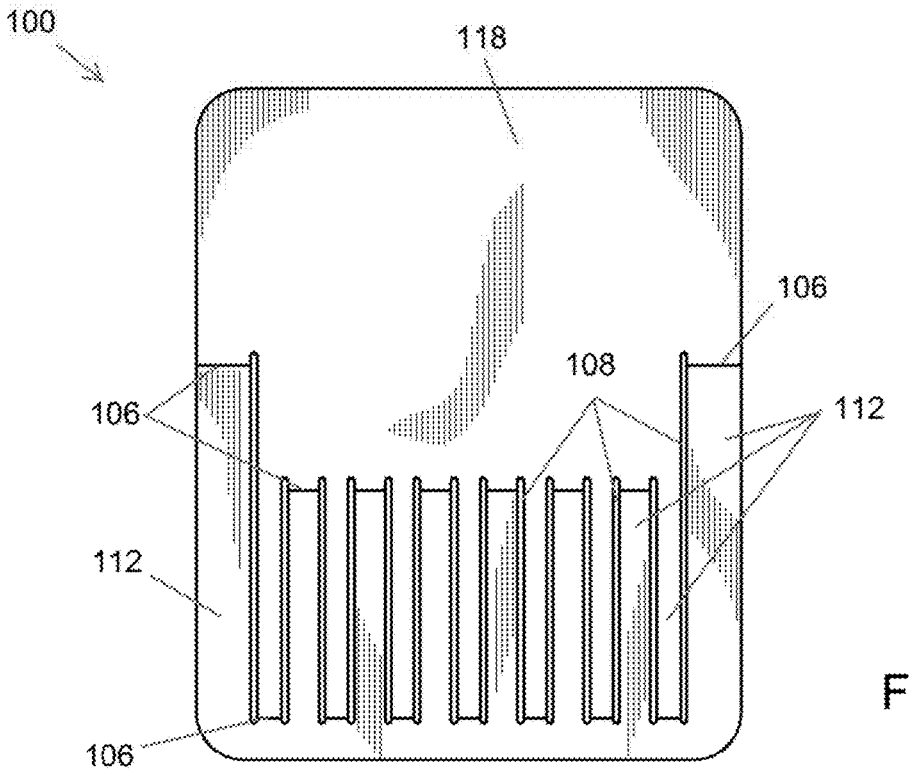
FIG. 3 is a rear elevational view of the chair of FIG. 1.
Figure 4:
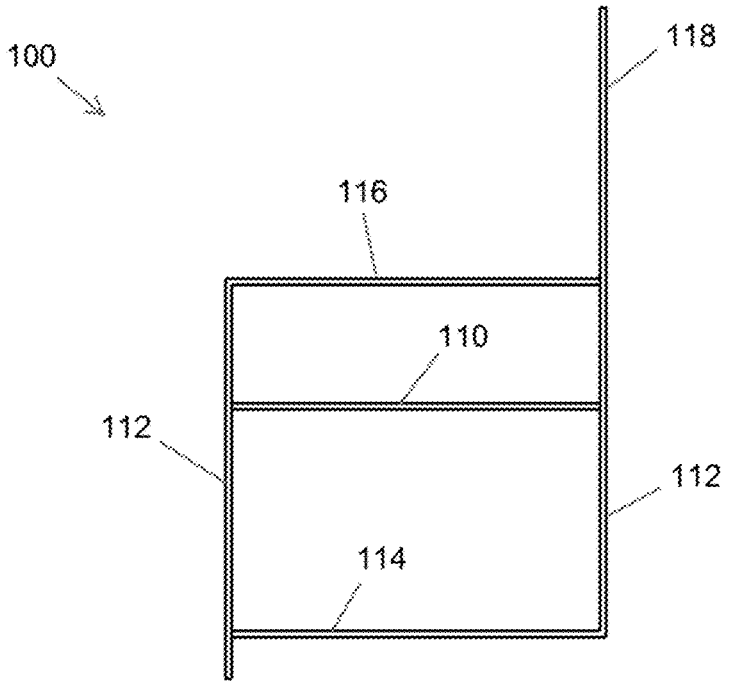
FIG. 4 is a left elevational side view of the chair of FIG. 1, wherein the right elevational side view of the chair is a mirror image of the left elevational side view.
Figure 5:
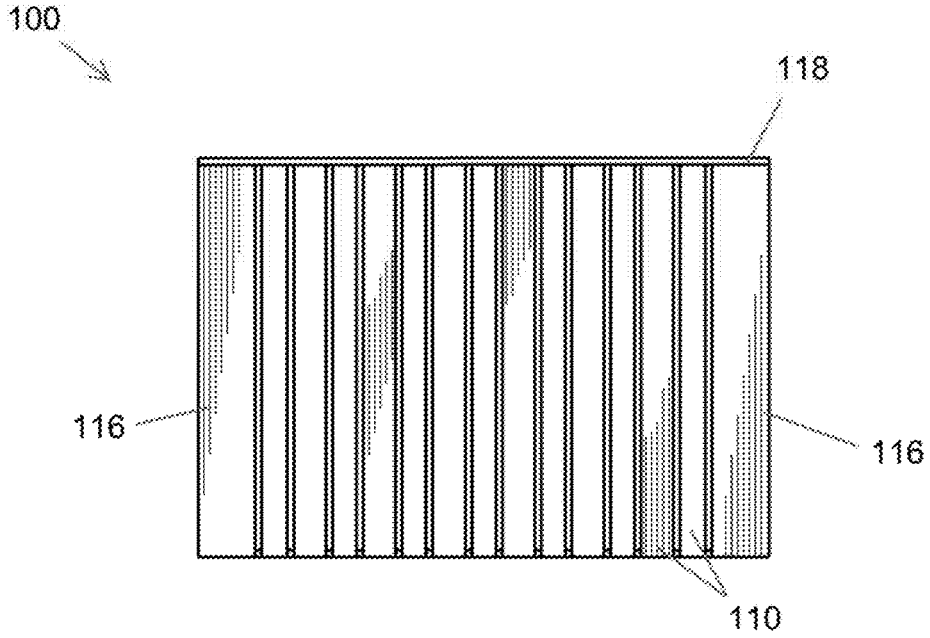
FIG. 5 is a top view of the chair of FIG. 1.
Figure 6:
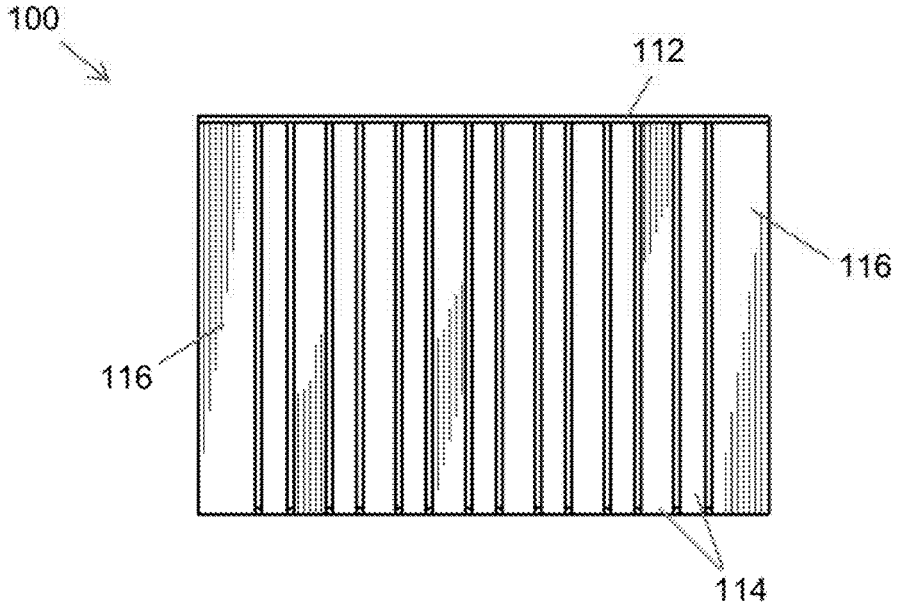
FIG. 6 is a bottom view of the chair of FIG. 1.
Figure 7:
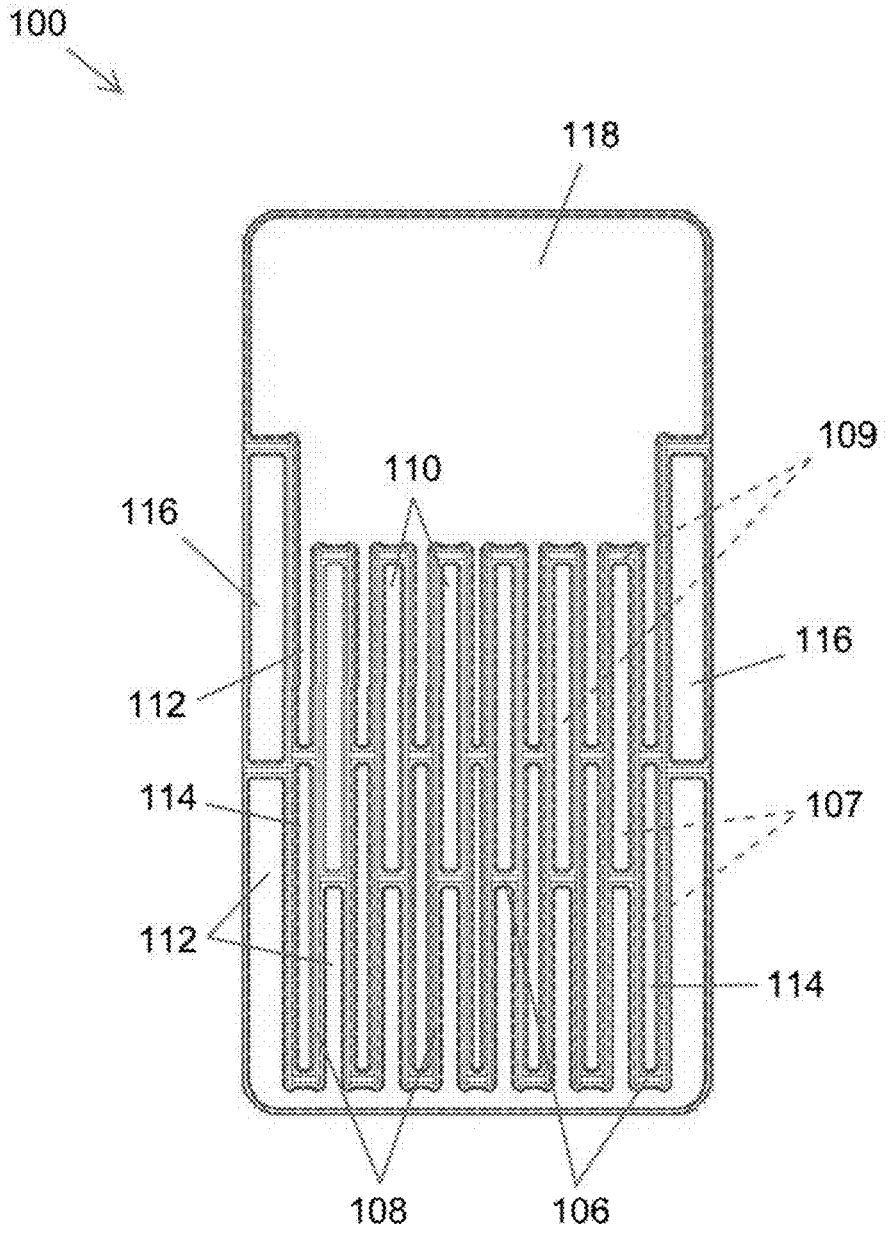
FIG. 7 is a front view of the chair of FIG. 1 in a collapsed configuration.
Figure 8D:
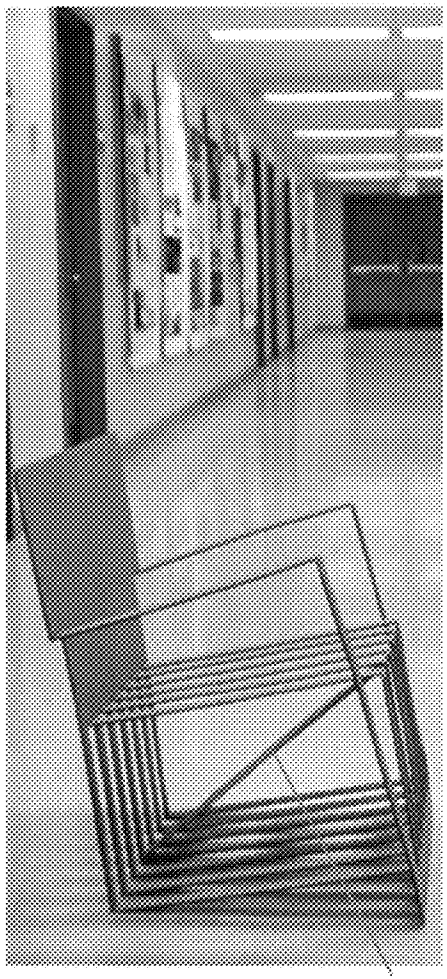
FIGS. 8A, 8B, 8C, and 8D are a series of images representing a process by which a model of a collapsible chair can be expanded from a relatively collapsed configuration (FIG. 8A) to an expanded configuration (FIG. 8D).
Figure 8C:
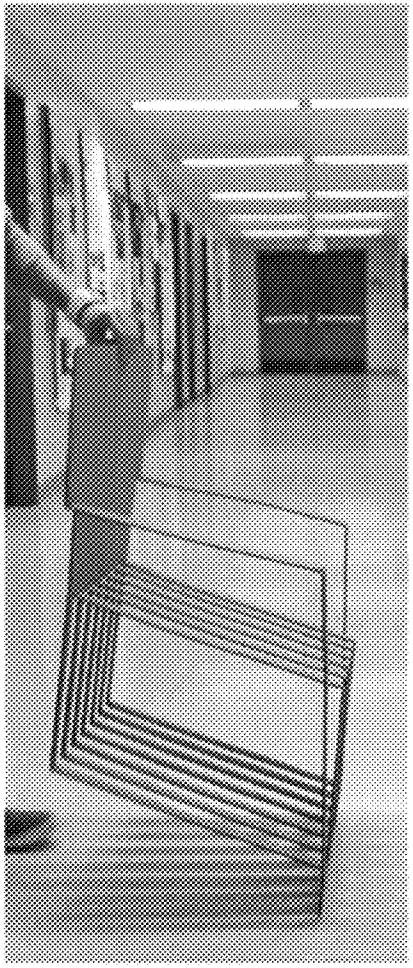
Figure 8B:
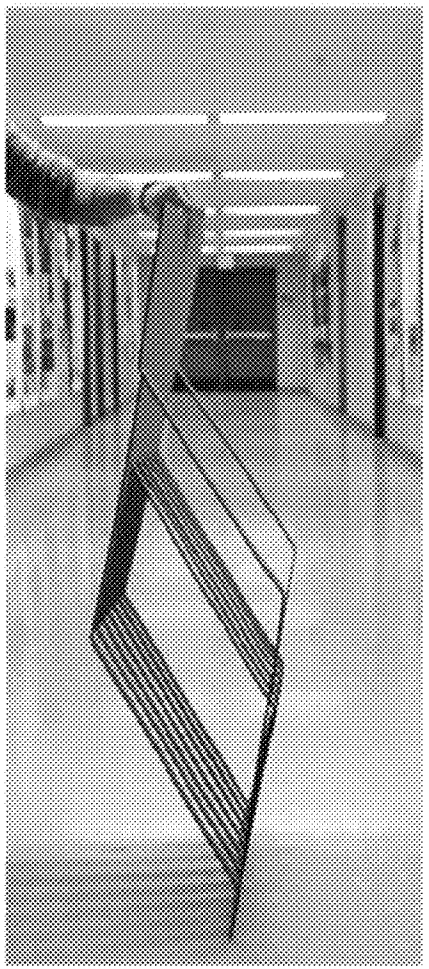
Figure 8A:
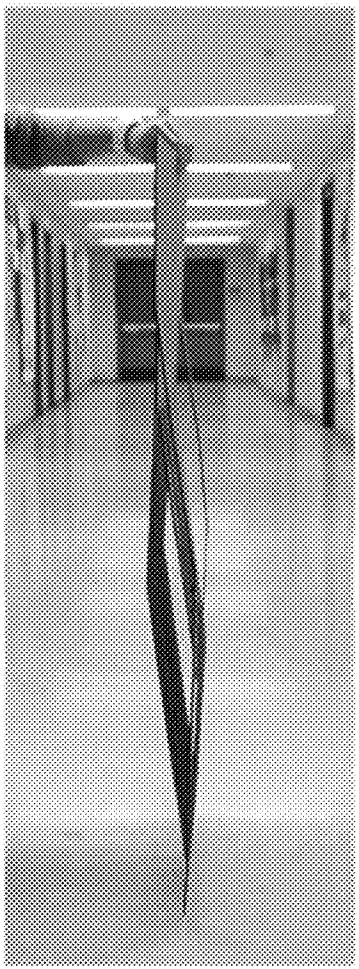
Figure 9:
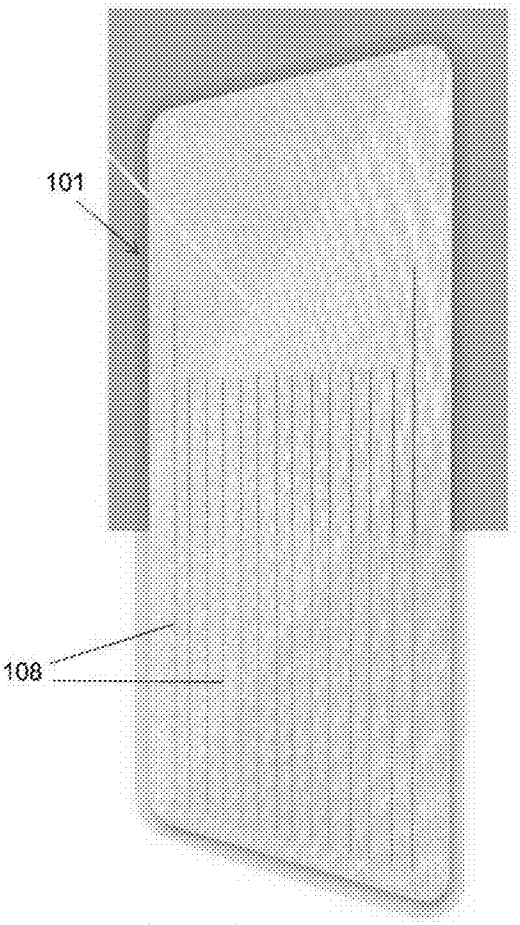
FIG. 9 represents a blank from which the collapsible chairs of FIGS. 1 through 7 can be fabricated in accordance with certain aspects of the invention.
Figure 10:
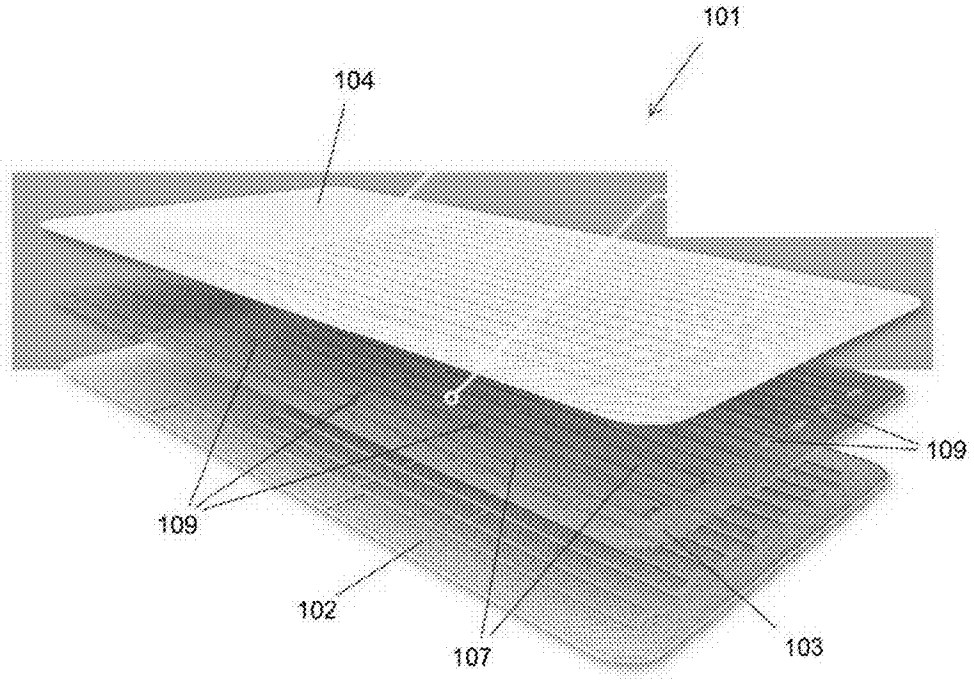
FIG. 10 is an exploded view representing various layers of a nonlimiting embodiment of the blank of FIG. 9.

FIGS. 1 through 8 represent nonlimiting embodiments of a collapsible chair 100. The chair 100 is configured to be selectively folded or arranged into one of at least two configurations. The chair 100 preferably may be folded between a collapsed configuration having a relatively planar shape suitable for efficient storage and shipping, and an expanded configuration suitable for use as a chair in which a user may sit. FIGS. 1-6 and 8D represent the chair 100 in a fully expanded configuration, FIG. 7 represents the chair 100 in a fully collapsed configuration, and FIGS. 8A through 8C represent the chair 100 in different partially collapsed stages between the fully collapsed and fully expanded configurations. FIG. 9 represents a nonlimiting embodiment of a blank 101 from which the collapsible chair 100 of FIGS. 1 through 8 can be fabricated, and FIG. 10 is an exploded view representing certain preferred but nonlimiting exterior layers 102 and 104 and an interior layer 103 that may be bonded together to form the blank 101 of FIG. 9.

To facilitate the description provided below of the embodiments represented in FIGS. 1 through 10, relative terms, including but not limited to, "vertical," "horizontal," "side," "upper," "lower," "longitudinal," "lateral," "above," "below," "right," "left," etc., may be used in reference to the perspective of an individual sitting in the chair 100 when in its expanded configuration, and therefore are relative terms that are useful to describe the chair 100 represented in FIGS. 1 through 8, but should not be necessarily interpreted as limitations to the construction and use of the chair 100.

FIGS. 1 through 6 identify multiple rigid structural members 110, 112, 114, 116 and 118 of various shapes as members of the chair 100, and represent each pair of adjoining structural members 110, 112, 114, 116 and 118 as connected by a revolute or hinge joint 106 that allows the adjoining pair to pivot relative to each other about a single axis of rotation. In the expanded configuration of FIG. 1, the structural members 110 define a seat, the structural members 112 define support legs, the structural members 114 define leg braces, the structural members 116 define armrests, and the structural members 118 define a back rest. It is within the scope of the invention that the chair 100 could have additional structural components suitable for maintaining the chair 100 in one or any of its configurations. For example, FIG. 8D represents the chair 100 as comprising an additional support brace 120. It is also within the scope of the invention that the chair 100 may be of other shapes and sizes than those represented.

As noted above, FIG. 10 is an exploded view representing two exterior layers 102 and 104 and an interior layer 103 of the blank 101 shown in FIG. 9. The blank 101 is represented as comprising multiple longitudinal slots 108 that are present in and may entirely pass through each of the layers 102, 103 and 104 to delineate the structural members 110, 112, 114, 116 and 118 of the chair 100, and specifically the longitudinal edges of the members 110, 112, 114, 116 and 118. The exploded view of FIG. 10 further shows lateral slots 109 that are present in and may entirely passing through the interior layer 103, but preferably are not present in and do not pass through the two exterior layers 102 and 104. As a result of the slots 108 and 109, the interior layer 103 defines discrete structural elements 107 that are located within and secured to one another through the exterior layers 102 and 104, but might not otherwise directly touch each other as a result of being separated by one or more longitudinal slots 108 and one or more lateral slots 109. The exterior layers 102 and 104 form the joints 106 at the lateral slots 109, and therefore the joints 106 may be referred to as lateral joints. In other words, each structural element 107 formed with the interior layer 103 is preferably entirely surrounded on all sides by combinations of the longitudinal slots 108, the lateral joints 106, and the outer perimeter of the chair 100 as is schematically represented in FIG. 7. As a result, the structural elements 107 are only interconnected with other structures of the chair 100 through the lateral joints 106.

According to one nonlimiting embodiment, the chair 100 may be produced by providing the interior layer 103 (e.g., wood), forming the longitudinal slots 108 and lateral slots 109 in the interior layer 103 to define the structural elements 107, and then locating the structural elements 107 between the two exterior layers 102 and 104 (e.g., leather), and sewing the two exterior layers 102 and 104 along edges of structural elements 107 of the interior layer 103. Portions of the two exterior layers 102 and 104 within the structural elements 107 may then be cut and removed to form the longitudinal slots 108, with the result that the structural elements 107 are entirely encased by the two exterior layers 102 and 104 and the structural members 110, 112, 114, 116 and 118 are integral components of the chair 100. Optionally, each of the two exterior layers 102 and 104 may be continuous over a respective side of the chair 100, that is, each of the layers 102 and 104 are formed of a single portion of material rather than multiple portions of material, for example, sewn together. It is foreseeable that the chair 100 may comprise additional layers, for example, a cushioning layer (not shown) between the interior layer 103 and one or both of the exterior layers 102 and 104.

As a result of the construction described above, the individual structural members 110, 112, 114, 116 and 118 are preferably only connected to adjacent structural members 110, 112, 114, 116 and 118 at longitudinal ends thereof by the exterior layers 102 and 104, which define the revolute or hinge joints 106 that have lateral orientations and allow for pivoting about a single axis of rotation. Consequently, the structural members 110, 112, 114, 116 and 118 pivot relative to adjoining structural members 110, 112, 114, 116 and 118 exclusively about laterally-oriented and parallel axes (joints 106), as do the seat, support legs, leg braces, arm rests, and back rest of the chair 100 formed by these structural members 110, 112, 114, 116 and 118. The hinge joints 106 provide the ability of the chair 100 to be collapsed and expanded between its collapsed and expanded configurations, and therefore the exterior layers 102 and 104 that define the joints 106 are preferably formed of flexible materials capable of reliably interconnecting unsupported portions of the structural elements 107 of the interior layer 103 between longitudinal ends thereof. Although this hinge function is represented herein as being provided solely by the flexibility of the exterior layers 102 and 104, it is within the scope of the invention that this function could be achieved by other means. For example, the structural members 110, 112, 114, 116 and 118 could be connected to adjacent structural members 110, 112, 114, 116 and 118 at longitudinal ends thereof with other types of mechanical hinges that allow pivoting therebetween.

In the fully collapsed configuration shown in FIG. 7, all of the structural members 110, 112, 114, 116 and 118 are preferably in the same plane and define a substantially planar shape. FIGS. 8A through 8D show a series of images representing a process by which the chair 100 can be expanded from a partially collapsed configuration (FIG. 8A) to a fully expanded configuration (FIG. 8D). It should be understood that the chair 100 may be folded into the collapsed configuration by reversing the steps of FIGS. 8A through 8D. During the expanding/collapsing process, the structural members 110, 112, 114, 116 and 118 pivot relative to adjacent structural members 110, 112, 114, 116 and 118 to transition between the configurations. During the transition between configurations, a first group of the structural members 110, 112 and 116 that define the seat, front set of support legs, and armrests of the chair 100 pivot and expand in a first outward direction relative to the plane of the collapsed chair 100 (to the right in FIGS. 8A-8D), and a second group of the structural members 112 and 114 that define the rear set of the support legs and the leg braces of the chair 100 pivot and expand in a direction that is generally opposite the first (to the left in FIGS. 8A-8D).

It is within the scope of the invention that the chair 100 could have additional structural components suitable for maintaining the chair 100 in one or any of its configurations. For example, FIG. 8D represents the chair 100 as comprising an additional support brace 120 that spans interior corners of the chair 100 defined by the seat (members 110), legs (members 112), and leg braces (members 114). It is also within the scope of the invention that the chair 100 may be of other shapes and sizes than those represented.

Figure 14:
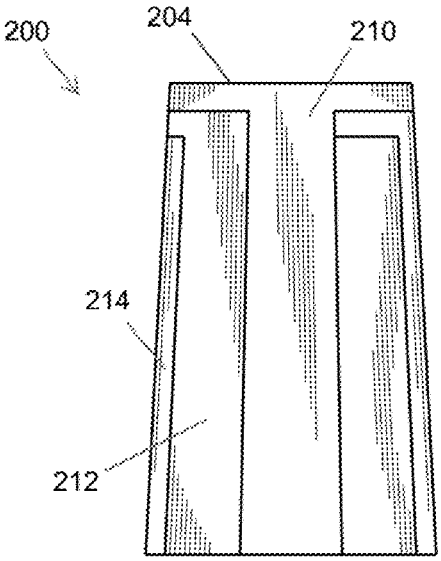
FIG. 14 is a first elevational side view of the stool assembly of FIG. 11.
Figure 13:
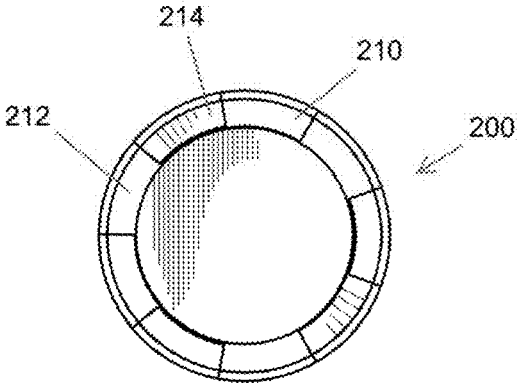
FIG. 13 is a bottom view of the stool assembly of FIG. 11.
Figure 15:
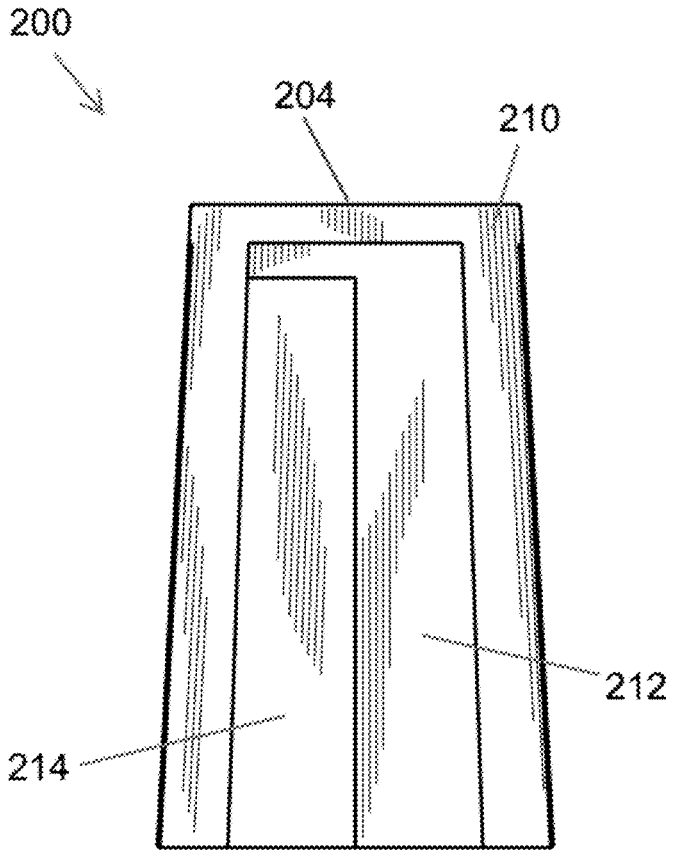
FIG. 15 is a second elevational side view of the stool assembly of FIG. 11, taken from a direction perpendicular to the first elevational side view of FIG. 14.
Figure 16:
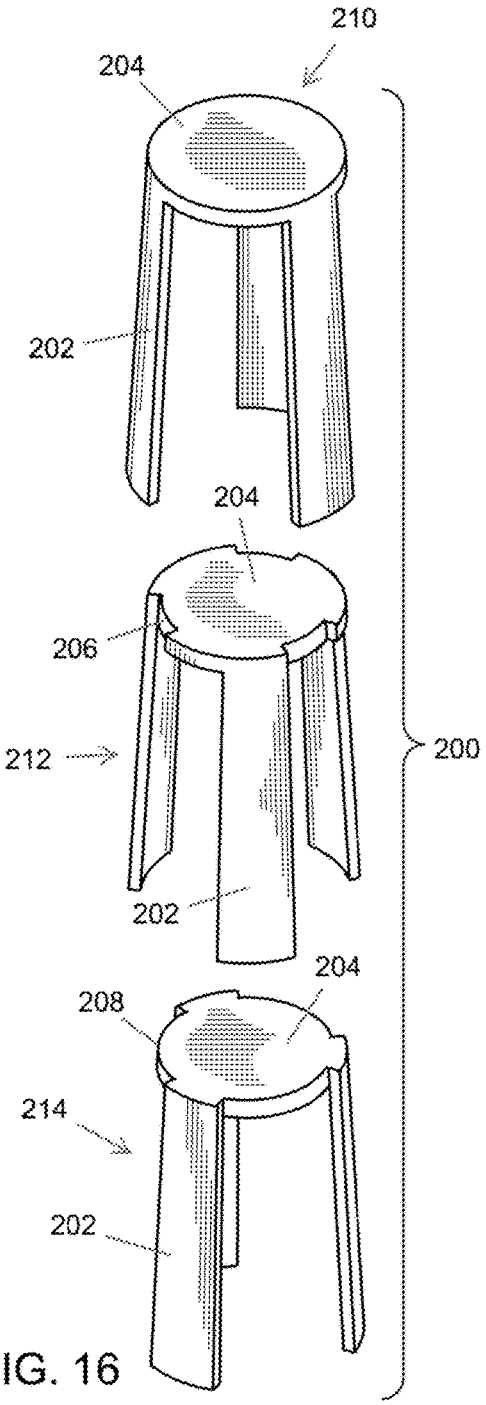
FIG. 16 is an exploded perspective view of the stool assembly of FIG. 11 showing the three individual stools unstacked and disassembled with one another and positioned end to end.
Figure 17:
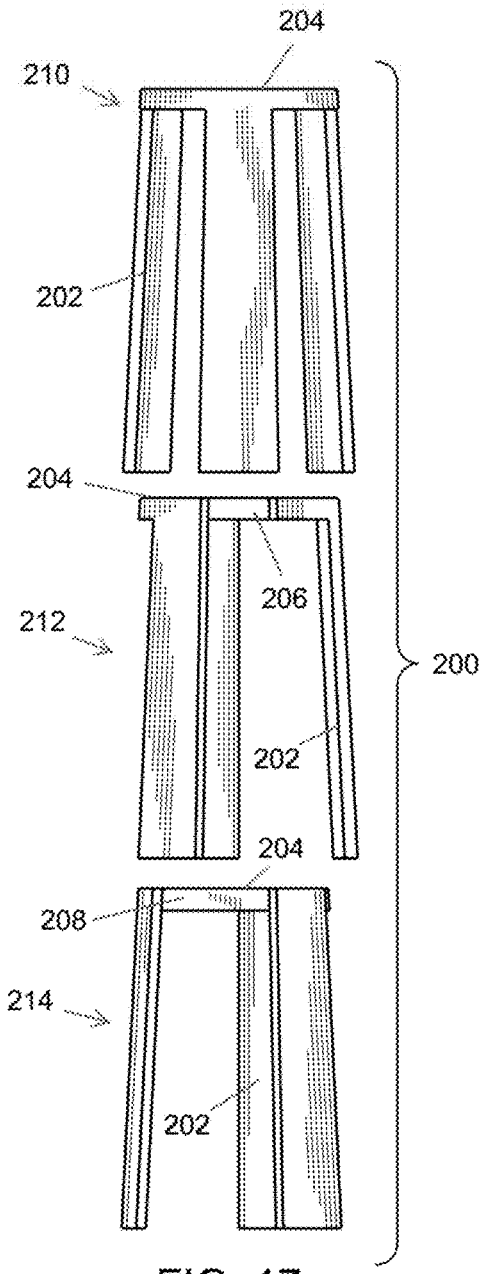
FIG. 17 is an exploded side view of the stool assembly of FIG. 11 showing the three individual stools unstacked and disassembled with one another and positioned end to end.
Figure 18:
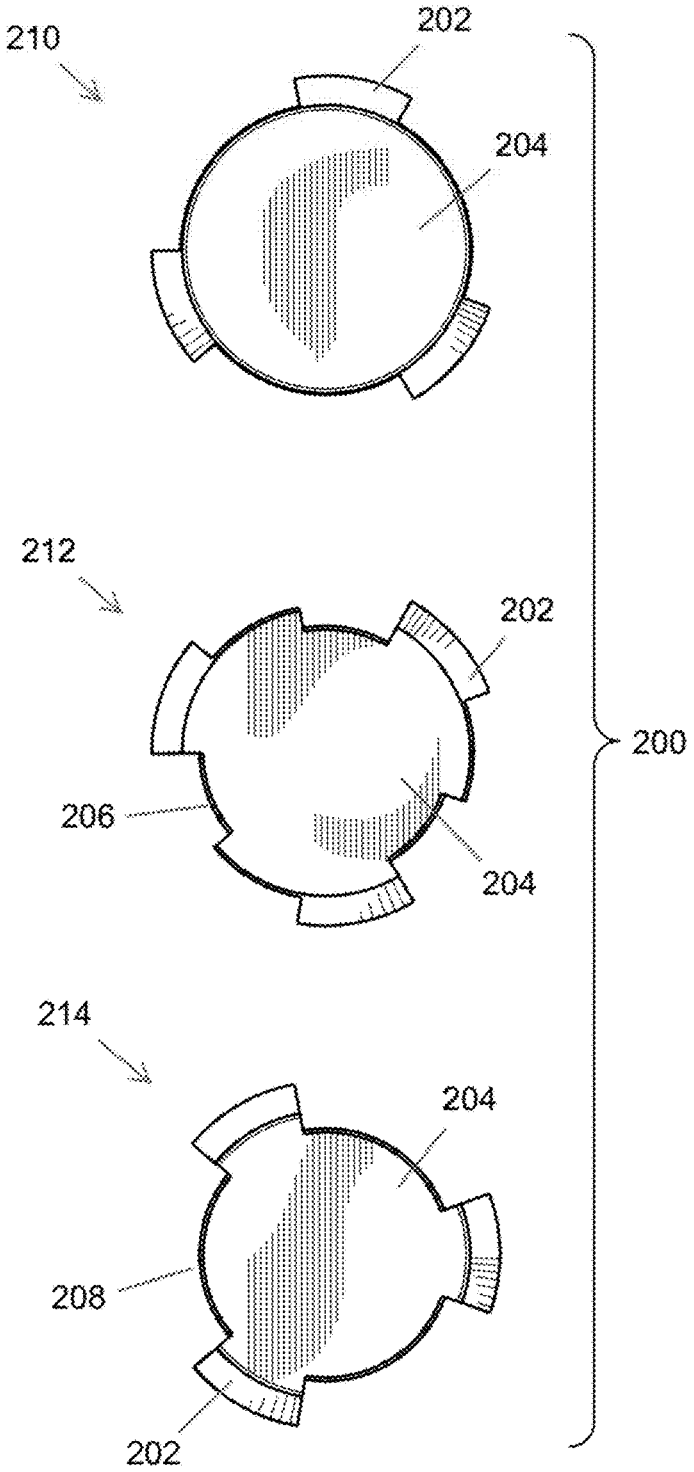
FIG. 18 is an exploded top view of the stool assembly of FIG. 11 showing the three individual stools unstacked and disassembled with one another and positioned side by side.

FIGS. 11 through 18 represent nonlimiting embodiments of a multi-piece stool assembly 200 that is configured for use as a single seat (FIGS. 11-15) or as multiple individual seats (FIGS. 16-18). The assembly 200 comprises multiple individual stools 210, 212, and 214 (FIGS. 16-18) that can be individually used as seats, but also configured to be selectively arranged for assembly by stacking to construct the stool assembly 200, resulting in a more compact configuration for storing. In the nonlimiting embodiment of FIGS. 11-18, each stool 210, 212 and 214 comprises a seat 204 and three legs 202 secured to its seat 204 and configured to support a load applied to the seat 204, for example, a person sitting on the seat 204 of the stool 210, 212, or 214.

Figure 11:
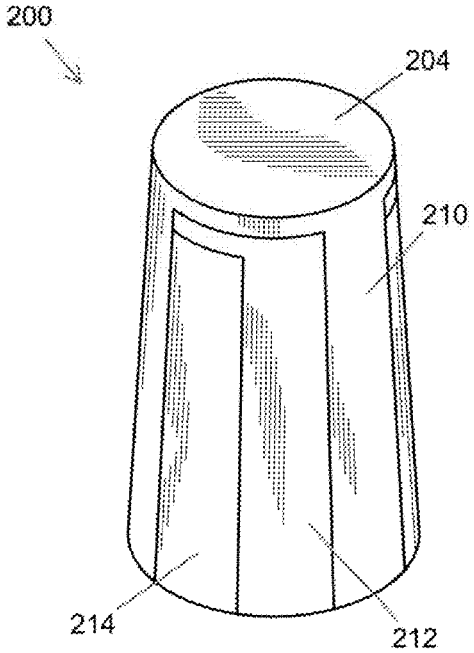
FIG. 11 is a front perspective view schematically representing a nonlimiting embodiment of a stool assembly comprising three individual stools stacked and assembled with one another in accordance with another aspect of this invention.
Figure 12:
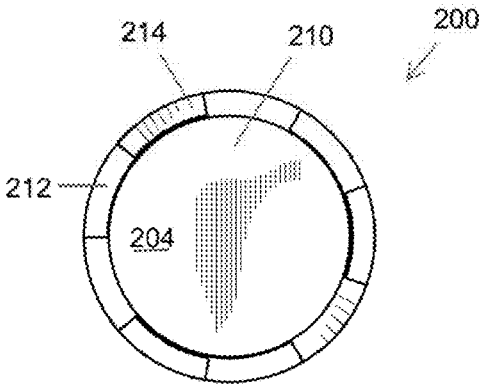
FIG. 12 is a top view of the stool assembly of FIG. 11.

FIGS. 11 through 18 show the stools 210, 212, and 214 as differing in height, size and shape, with the stool 210 being the tallest, the stool 214 being the shortest, and the stool 212 being intermediate the stools 210 and 214 in height to enable the stool 212 to be stacked between the stools 210 and 214 with their respective seats 204 parallel and face to face as evident from FIGS. 11, 14, and 15. As used herein, the faces of the stools 210, 212, and 214 are the upper surface of a seat 204 that is intended for an individual to sit on and the lower surface oppositely disposed the upper surface, and face to face refers to a configuration wherein a lower surface of the seat 204 of one of the upper stools 210 or 212 is abutting an upper surface of the seat 204 of one of the lower stools 212 or 214. To achieve these differences in height, the legs 202 of the tallest stool 210 are longer than those of the other stools 212 and 214, the legs 202 of the shortest stool 214 are shorter than those of the other stools 210 and 212, and the legs 202 of the intermediate stool 212 have lengths that are intermediate those of the other stools 210 and 214 and, more particularly, differ in length by a distance approximately equal to the thickness of its seat 204. In contrast, FIGS. 11 through 18 represent the legs 202 of all three stools 210, 212 and 214 as having substantially equal widths and thicknesses (as measured in the lateral/horizontal directions).

When the stools 210, 212 and 214 are assembled as shown in FIGS. 11 through 15, the stool assembly 200 comprises what may be described as a single composite base made up of the legs 202 of the individual stools 210, 212, and 214, which are interdigitated or nested together to create a generally frustoconical shape for the composite base of the stool assembly 200. The composite base is able to support a load applied to the seat 204 of the tallest stool 210, which serves as the seat for the stool assembly 200. With this arrangement, a load applied to the seat 204 of the stool assembly 200, for example, a person sitting on the seat 204 of the tallest stool 210, will preferably be supported by the legs 202 of all three of the stools 210, 212, and 214. Although not shown, less than all of the individual stools 210, 212, and 214 could be stacked to form a partially combined configuration. Preferably, longitudinal edges of the legs 202 of the individual stools 210, 212 and 214 contact each other when assembled as the single composite base. Alternatively, gaps (not shown) may be provided between the legs 202 of one or more of the stools 210, 212 and 214.

As evident from FIGS. 11 through 15, the assembly 200 can have relatively uniform and continuous exterior surfaces. To achieve this shape, the seat 204 and legs 202 of each stool 210, 212 and 214 are uniquely configured to enable the stools 210, 212 and 214 to be assembled via stacking to construct the assembly 200. For example, whereas FIGS. 11, 12, 16, and 18 represent the seat 204 of the tallest stool 210 as having an uninterrupted circular perimeter, the seat 204 of the intermediate stool 212 has a perimeter interrupted by recesses 206 located between its legs 202 so that each recess 206 can accommodate one of the legs 202 of the tallest stool 210, and the seat 204 of the shortest stool 214 has a perimeter interrupted by wider recesses 208 located between its legs 202 so that each recess 208 can accommodate one leg 202 of each of the tallest and intermediate stools 210 and 212.

The stools 210, 212 and 214 may be formed of any material, and each of the stools 210, 212 and 214 may be formed of the same or different materials. One or more of the stools 210, 212 and 214 may have a different surface texture, color, ornamental pattern, etc. in order to provide different appearances between the stools 210, 212 and 214, as well as an aesthetically interesting appearance for the assembly 200. It is within the scope of the invention that the assembly 200 may comprise any number of individual stools 210, 212 and 214, each of the stools 210, 212 and 214 may have any shape, and each of the stools 210, 212 and 214 may be formed of any material. Although not shown in the drawings, it is foreseeable that the assembly 200 may comprise a means for securing one or more of the stools 210, 212 and 214 in a combined or a partially combined configuration (e.g., including two of the three stools 210, 212, and 214).

FIGS. 19 through 23 represent nonlimiting embodiments of systems suitable for constructing or assembling furniture. In particular, the system may include multiple joints 300 having openings or slots 302 configured to slidably receive and/or retain rigid structural members 304 therein. When assembled with structural members 304, the system can be used to define a piece of furniture having the joints 300 located at corners of the piece of furniture. In practice, a user may easily create a custom sized and shaped piece of furniture without the necessity of the user having extensive woodworking (or other craftsman) knowledge and skill that may ordinarily be necessary for creating a custom piece of furniture. Preferably, the system includes multiple joints 300 which may be assembled with structural members 304 that are included with the system, or provided separately by the user.

As a nonlimiting example, FIGS. 20-23 represent a bench 310 formed of eight structural members 304 (for example, wood boards) secured with four joints 300. Each of the joints 300 includes three openings or slots 302 into which ends of the structural members 304 are inserted. Although each of the structural members 304 in this embodiment have identical widths and thicknesses, their lengths are varied to define the shaped and structure of the desired bench 310. The system may be made available as a kit that includes the structural members 304 precut to desired lengths, or the members 304 may be separately obtained and cut to length by the user.

Figure 19:
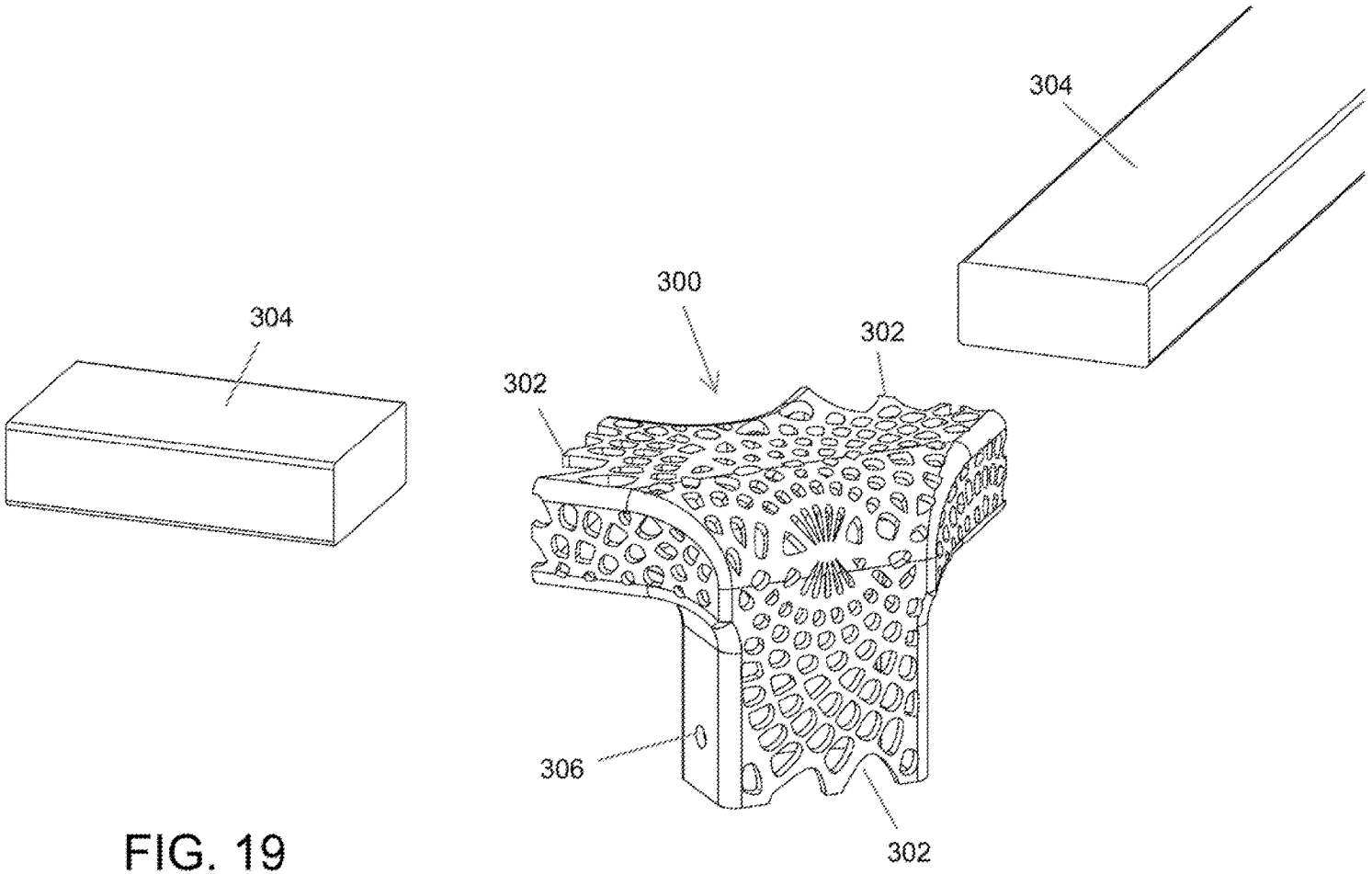
FIG. 19 represents a nonlimiting embodiment of a joint having slots therein sized and shaped to receive structural members in accordance with another aspect of the invention.
Figure 20:
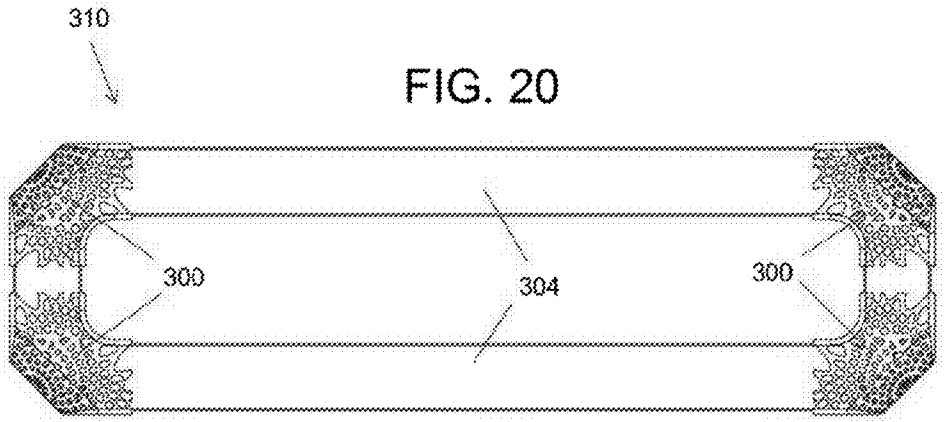
FIGS. 20 through 23 are top, side, end, and perspective views, respectively, of a bench formed from joints and structural members of the types shown in FIG. 19.
Figure 21:
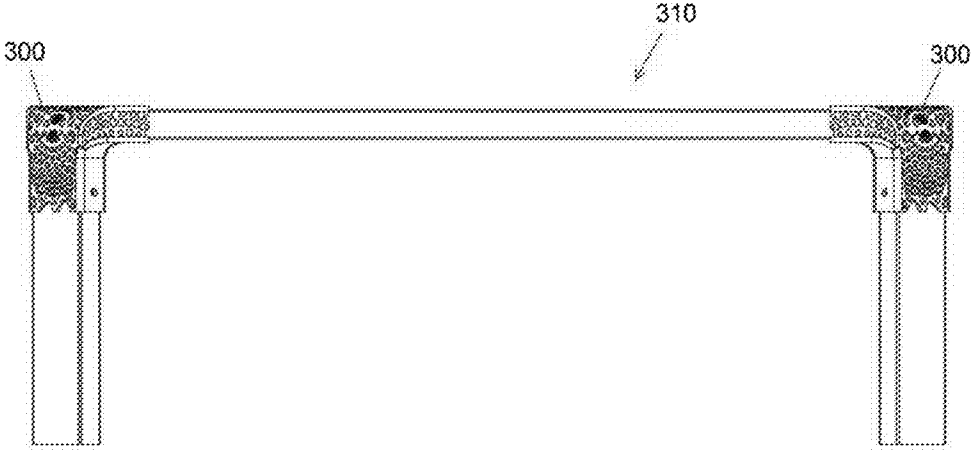
Figure 22:
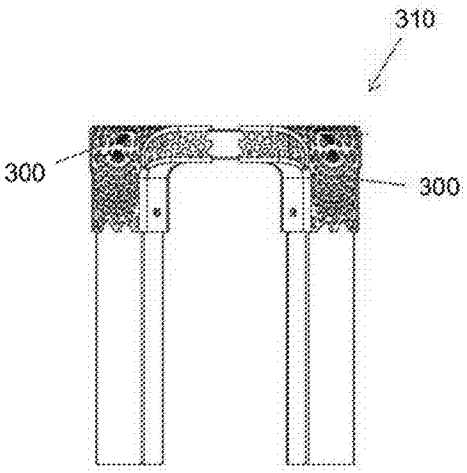
Figure 23:
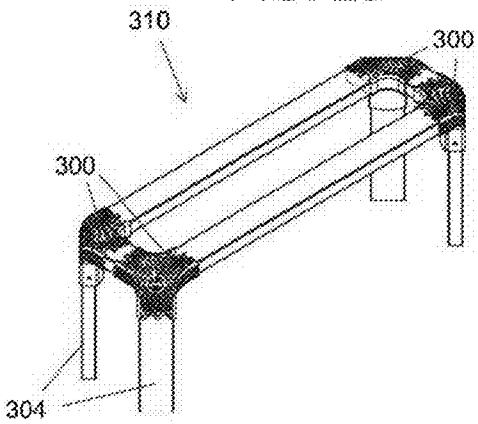

Optionally, the joints 300 may define corners having any desired shape, but do not require complicated cuts to the ends of the structural members 304. For example, FIG. 19 represents the joint 300 as defining a rounded, chamfered or beveled corner for a piece of furniture, through the structural members 304 to be inserted in the slots 302 of the joint 300 have simple flat ends formed at ninety degrees to the longitudinal sides of the members 304.

The joints 300 may include holes 306 for insertion of fasteners to secure the structural members 304 after assembly. Alternatively, the slots 302 of the joints 300 may be configured to secure the structural members 304 by an integral retention feature, interference fit, or any other suitable means.

It is within the scope of the invention that the joints 300 may have any shape, and/or the system may comprise multiple types of joints 300 such that various types of custom furniture may be built. The joints 300 may include designs, cutouts, protrusions, indentations, shaped portions, etc., in order to provide ornamental and/or secondary functional features. For example, the joints 300 of FIGS. 19-23 include an array of through holes having various sizes and shapes that define an ornamental pattern. The joints 300 may be formed of any material suitable for securing the structural members 304 to form the furniture, including but not limited to polymers, metals, composites, etc. The structural members 304 may be formed of an material including, but not limited to, woods, polymers, composites, and metals. —While the invention has been described in terms of specific or particular embodiments, it is apparent that other forms could be adopted by one skilled in the art. For example, the chair 100, assembly 200, joints 300, and their respective components could differ in appearance and construction from the embodiments described herein and shown in the drawings, functions of certain components of the chair 100, assembly 200, joints 300 could be performed by components of different construction but capable of a similar (though not necessarily equivalent) function, and various materials could be used in the manufacturing of the chair 100, assembly 200, joints 300, and their components. Accordingly, it should be understood that the invention is not limited to any embodiment described herein or illustrated in the drawings. It should also be understood that the phraseology and terminology employed above are for the purpose of describing the illustrated embodiments, and do not necessarily serve as limitations to the scope of the invention. Therefore, the scope of the invention is to be limited only by the following claims.

The invention claimed is:

1. A collapsible chair configured to be selectively arranged into collapsed and expanded configurations, the collapsible chair comprising:

multiple rigid structural members having hinge joints at ends thereof pivotally coupling each of the structural members to one or more adjoining structural members, the hinge joints defining parallel axes so that the structural members pivot relative to each other about the parallel axes; and a flexible material encasing each of the structural members, the hinge joints being provided solely by the flexible material between the ends of the structural members;

wherein the collapsible chair is configured to be arranged in the collapsed configuration wherein all of the structural members are in the same plane and define a substantially planar shape, and configured to be arranged in the expanded configuration wherein a first group of the structural members define a seat, a front set of support legs, and armrests of the collapsible chair and expand in a first outward direction relative to the plane of the structural members in the collapsed configuration, and a second group of the structural members that define a rear set of support legs and leg braces connecting the front and rear set of support legs of the collapsible chair and expand in a second direction that is generally opposite the first outward direction, wherein the hinge joints enable the structural members to pivot about the parallel axes relative to the one or more adjoining structural members so that the collapsible chair can be selectively collapsed and expanded between the collapsed and expanded configurations.

2. The collapsible chair of claim 1, wherein the second group of the structural members further define a back rest.

3. The collapsible chair of claim 1, wherein the seat, front set of support legs, armrests, rear set of support legs, and leg braces are integral components of the collapsible chair.

4. The collapsible chair of claim 1, wherein the flexible material includes inner and outer layers and the inner and outer layers are secured to one another at the hinge joints.

5. The collapsible chair of claim 4, wherein the inner and outer layers are each continuous over a respective side of the collapsible chair.

6. The collapsible chair of claim 1, further comprising:

a brace configured to maintain the collapsible chair in at least the expanded configuration.

7. A method of reconfiguring a collapsible chair claim 1, the method comprising:

providing a collapsible chair, wherein the collapsible chair comprises:

multiple rigid structural members having hinge joints at ends thereof pivotally coupling each of the structural members to one or more adjoining structural members, the hinge joints defining parallel axes so that the structural members pivot relative to each other about the parallel axes; and a flexible material encasing each of the structural members, the hinge joints being provided solely by the flexible material between the ends of the structural members;

wherein the collapsible chair is configured to be arranged in the collapsed configuration wherein all of the structural members are in the same plane and define a substantially planar shape, and configured to be arranged in the expanded configuration wherein a first group of the structural members define a seat, a front set of support legs, and armrests of the collapsible chair and expand in a first outward direction relative to the plane of the structural members in the collapsed configuration, and a second group of the structural members that define a rear set of support legs and leg braces connecting the front and rear set of support legs of the collapsible chair and expand in a second direction that is generally opposite the first outward direction, wherein the hinge joints enable the structural members to pivot about the parallel axes relative to the one or more adjoining structural members so that the collapsible chair can be selectively collapsed and expanded between the collapsed and expanded configurations, unfolding the collapsible chair from the collapsed configuration to the expanded configuration; and then folding the collapsible chair to return the collapsible chair to the collapsed configuration.

* * * * *